United States Patent [19]

Betta

[11] 4,090,675

[45] May 23, 1978

[54] ADHERING DEVICE FOR GENERAL ROPE WINDING UP

[75] Inventor: Walter Betta, Bergamo, Italy

[73] Assignee: Wabing S.r.l., Bergamo, Italy

[21] Appl. No.: 781,320

[22] Filed: Mar. 25, 1977

[30] Foreign Application Priority Data

Mar. 26, 1976 Italy ..... 21598 A/76

[51] Int. Cl.[2] ..... B65H 51/20

[52] U.S. Cl. ..... 242/47; 242/47.01; 242/47.08; 242/47.12; 242/117

[58] Field of Search ..... 242/47, 47.01, 47.02, 242/47.03, 47.04, 47.05, 47.06, 47.07, 47.08, 47.09, 47.1, 47.11, 47.12, 47.13, 54 R, 117; 254/150 R; 74/224

[56] References Cited

U.S. PATENT DOCUMENTS

| | | | |
|---|---|---|---|
| 1,744,779 | 1/1930 | Massingham | 242/47.12 X |
| 1,752,604 | 4/1930 | Massingham | 242/47.12 X |
| 2,659,225 | 11/1953 | Ewing | 242/47.01 X |
| 2,836,983 | 6/1958 | Stewart | 242/47.12 X |

FOREIGN PATENT DOCUMENTS

| | | | |
|---|---|---|---|
| 248,703 | 12/1963 | Australia | 242/47.01 |
| 964,252 | 5/1957 | Germany | 242/47.12 |
| 973,868 | 6/1960 | Germany | 242/47.12 |
| 329,708 | 5/1930 | United Kingdom | 242/47.12 |

*Primary Examiner*—Stanley N. Gilreath

[57] ABSTRACT

An adhering device for winding up any kind of ropes, comprising a loop forming track, means for supporting said track so that one section or length of the track is helically wrapped or wound about a first ideal cylindrical surface forming a number of turns, and another section or length of the track is in turn helically wrapped or wound, also forming a number of turns about a second ideal cylindrical surface, internally of the former and coaxial therewith, and means for driving said track so that each of the track elements would move along a path including a helical length about said first cylindrical surface and a helical length about said second cylindrical surface internally of the first surface, so that each of the track elements, after covering said helical length on the first cylindrical surface will cover the helical length on the second cylindrical surface and then re-cover the first surface and so on, said track being provided with a groove for accomodating the rope or the like winding up on said track along the helical length of said first cylindrical surface.

7 Claims, 5 Drawing Figures

ADHERING DEVICE FOR GENERAL ROPE WINDING UP

In order to impart a given mechanical tension to ropes without any discontinuity thereto, the systems being used are those grounded on adherence. Such systems provide that the ropes are wound up by a plurality of turns about a cylindrical element. As well known, under such conditions the tension in a rope would would vary from the first to the last turn in accordance with the following law or equation:

$$T1/T2 = e^{\alpha f},$$

wherein T1 is the initial tension, T2 is the final tension, $e$ is the basis of the natural logarithms, $\alpha$ is the total winding arch, generally exceeding $2\pi$, and $f$ is the coefficient of friction between the rope and cylinder. Adhering systems are highly efficacious and generally do not give rise to any drawbacks or disadvantages when the rope is stationary or not moving. On the other hand, when the rope is moving and the number of turns is necessarily more than one, novel phenomena occur, considerably disturbing the system balance.

Such phenomena will now be pointed to.

When a plurality of turns are wound up about a cylinder and the latter is moved, on one side the rope is wound up and on the other side it unwinds or uncoils, but on doing this the whole unit of turns is displaced as it were screwed on the support. Since the cylinder is of finite dimension, in a very short time the rope will reach one end thereof and should the movement continue, due to the impossibility of translating, it accumulates against the flange, getting superimposed in disorderly and inconsiderate manner.

In order to overcome such disadvantages, various systems have been used, among which those more successful are the bollard system and the adhering dual wheel system. The former is the oldest system, usually used in navy in anchor winches. The wheel or roller about which the rope is wound up is of a parabolic profile. The operation is as follows: during movement, the rope has the tendency of translating in the direction of the increasing diameters. The tension, at which the rope is stretched, shows itself on the drum or roller with radial forces that, due to the specific profile, would generate a force in a direction opposite to the movement or translation direction. In order that the system can operate, it is obviously required that the rope continuously slides on the drum. The major advantage of this machine resides in its simplicity. The system does not exhibit serious disadvantages when the amount of rope to be recovered is reasonable and the recovery tension thereof is also moderate. At high loads in the rope, more evident will be the results of continuous translation or movement on the drum in the form of a twist or torsion tending to change the relative position of the strands comprising such a rope; elemental wire or thread wear caused by slipping adds to said torsion or twist.

The latter or second system is more improved from a technical standpoint and enables to obtain acceptable results. Such a system provides two multi-groove wheels, both of which are driving wheels. The two wheels are arranged so that the grooves of the first wheel are laterally displaced by half a pitch relative to those of the second wheel. During movement, the rope being wound up about the two wheels is no longer subjected to the lateral translation movement which, as above referred to, is one of the most serious faults in the former system. Unfortunately, also this rope tensioning method has a number of faults. The major faults are as follows:

(1) The rope wound up about the two wheels passes from maximum tension on the first turn to a substantially zero tension on the last turn. In order to release, it should shorten by a degree or amount equivalent to the resilient extension previously imparted thereto when tensioned. Since such a shortening should occur while being wound up about wheels all of which of a same diameter and peripheral or surface speed, a situation of hyperstaticity would result, making it substantially impossible to determine the load on the axes of the two wheels.

(2) The adhering systems for rope tensioning are selected when the amount of rope to be recovered is substantial. Thus, over the machines directly re-winding up the rope onto a spool, such systems have the advantage that the use thereof is unaffected by its length. Of course, for such a condition, it is required that the connection joints between the several rope sections being used can pass on the adhering wheels. When using the system having two grooved wheels, the joint passage occurs with some difficulty. Thus, after passing on the first groove, in order to move to the second groove, it has to recover an amount of rope equivalent to the increase in development resulting from its larger diameter. This phenomenon arises again, being enhanced every time that on leaving a groove the joint reaches the next subsequent groove. In practice, it was found that the maximum stress in the rope occurs during passage on the third groove of the first wheel. At this position, the adherence between rope and groove may be such that no further relative sliding is allowed. Under this circumstance, the required elongation can only resiliently occur. The tension in the rope and accordingly in the machine would then attain such very high rates that in some cases failure conditions might be reached.

(3) When winding up a rope about a pair of multi-groove adhering wheels, for each revolution the rope undergoes as many bending cycles as the grooves being encountered, so that, for example, should the system provide two wheels having five grooves each, a rope from the inlet to the outlet from a machine has to undergo ten complete bending cycles. In addition thereto, in presently made machines, when due to constructive requirements the two wheels are closely located, having to displace by half a pitch, on passing from one groove to the other, a rope slides on the groove sides. Should the specific pressures between the rope and groove be of a high rate, this sliding takes the form of a torsion. Both of these phenomena are highly deleterious to the life effects of a rope, such that for particular services, such as for example the mechanical laying out for the conductors of aerial electrical lines, with such machines only particular types of interlaced stranded ropes can be used, which beside being highly flexible are completely inert to torsion.

It is the primary object of the present invention to remove the above cited disadvantages, and particularly to provide a system having all of the above mentioned advantages of the known systems, but without having the faults thereof.

According to the present invention, there is provided an adhering device for winding up ropes or the like, which device is essentially characterized by comprising a looped track, means for supporting said track so that a section or length of the latter is helically wrapped about a first ideal cylindrical surface forming a number of turns, and another section or length of the track is in turn helically wrapped, also forming a number of turns, about a second ideal cylindrical surface internally of the former and coaxial therewith, and means for driving the track so that each element thereof will move along a path comprising a helical length about said first cylindrical surface and a helical length about said second cylindrical surface internally of the former, whereby each of the track elements, having covered said helical length on the first cylindrical surface, will cover the helical length on the second cylindrical surface, then re-covering the first surface and so on, said track being provided with a groove for accomodating a rope or the like winding up on said track, along the helical length on the first cylindrical surface.

In order to more clearly show these and further features of the device according to the present invention, as well as the advantages resulting therefrom, an exemplary embodiment of the device according to the invention will now be described with reference to the accompanying drawings, in which.

Figure 1:
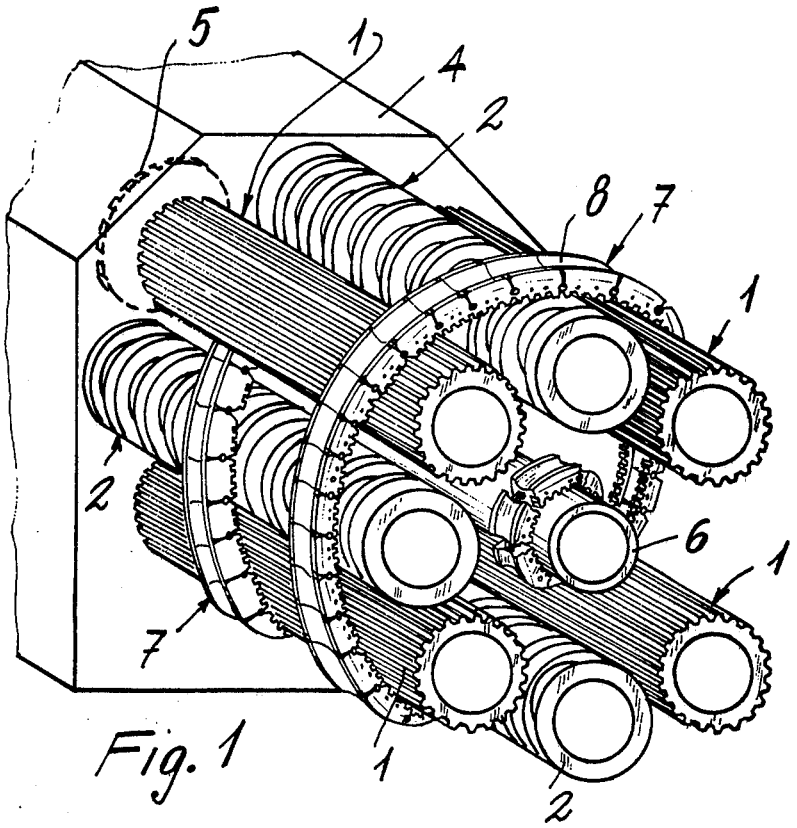
FIG. 1 is a perspective view of the device.

The device comprises a set of rollers, and particularly some rollers are all denoted at 1 and other rollers are denoted at 2.

Rollers 1 are identical to one another and rollers 2, different from rollers 1, are also identical to one another. More particularly, each roller 1 has a modular toothing throughout its length, the toothing being provided at a slope for reasons to be discussed in the following.

Each roller 2 is provided with a circumferential guide 3. Rollers 1 and 2 are carried by mountings fixed with frame 4 and the axes thereof, that is geometrical axes, lie on a cylindrical surface, or are the generatrices of said ideal cylindrical surface.

The rollers are rotable about the axes thereof; and particularly the rollers are carried on ball bearings mounted on shafts secured to said fixed frame 4.

All of said toothed rollers 1 are rotably driven by as many gear wheels keyed to the rollers; more particularly, a gear wheel 5 is keyed to one end of each roller 1.

These gear wheels 5 are controlled by a suitable reduction gear (not shown for the sake of simplicity).

At the center of the above described assembly of rollers 1 and 2, and more particularly along the geometrical axis of the ideal cylinder, on which the axes of rollers 1 and 2 are arranged, a roller 6 having a smooth outside surface is provided, while a plurality of such rollers 6 can be provided.

Roller 6 is an idle roller, that is freely rotable about its own axis, geometrical axis fixed with frame 4. A track, designated as a whole at 7, is provided and comprises a series of interarticulated elements.

Each of the track elements, designated as a whole at 8, comprise both an external band 9 having a groove for accomodating the rope and a toothed band 10 with a toothing having the same modulus as that of the rollers, on which said band 10 is intended to bear or rest.

The two parts or bands 9 and 10 are integral with each other. In this example, part or band 9 has a flange 11 secured thereto intended to contact the rope; in other terms, the groove of the track element comprises in this example said flange 11, which is made of suitable plastic material.

Figure 4:
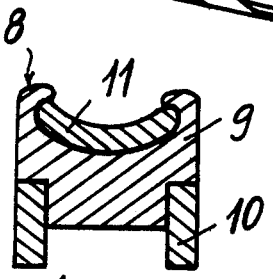
FIG. 4 is a cross-section for a detail of a track element.
Figure 2:
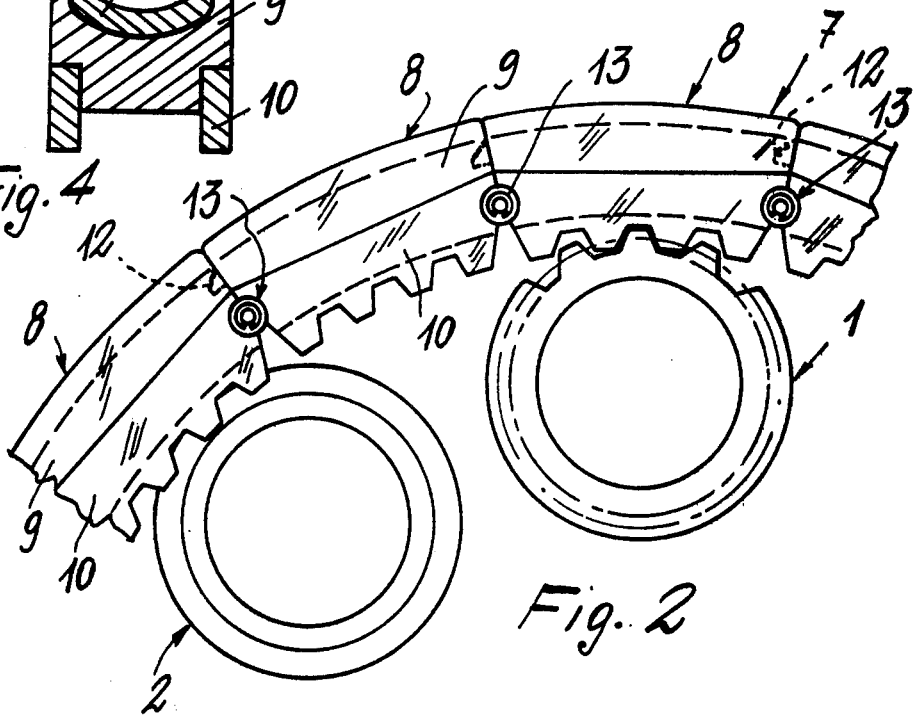
FIG. 2 is a view on an enlarged scale with respect to FIG. 1, showing a detail relating to the connection between a track and rollers.

Flange 11 is held or restrained to part 9 by suitable lips formed in the sides (particularly see FIG. 4).

Moreover, at one end each of elements 8 comprise a tooth 12 and also comprise at the opposite end a seating for accomodating the tooth 12 of the adjacent element 8.

The several elements 8, identical to one another and together making up the track 7, are hinged to one another. More particularly, the connection between said elements 8 is provided by hinges 13 of a cylindrical type, the connection by means of said hinges being such that the track has an excellent flexibility in the longitudinal plane and a reasonable flexibility in the transverse plane. Flexibility in the transverse plane is afforded by the clearance provided between the pin and hole for one of the hinge parts. The above described track 7, comprising said elements 8 hinged to one another, is helically wrapped on the outside rollers 1 and 2.

The two ends of the track enter between the spaces left between the rollers, and helically wrap about the central roller 6 to interconnect, so as to form a loop.

In other terms, the looped track 7 has a section or length forming a cylindrical helix about the cylinder defined by rollers 1 and 2 having a slope as defined by said track, and an inner section or length also forming a cylindrical helix with an opposite slope to the former about an inner cylinder defined by roller 6.

Figure 5:
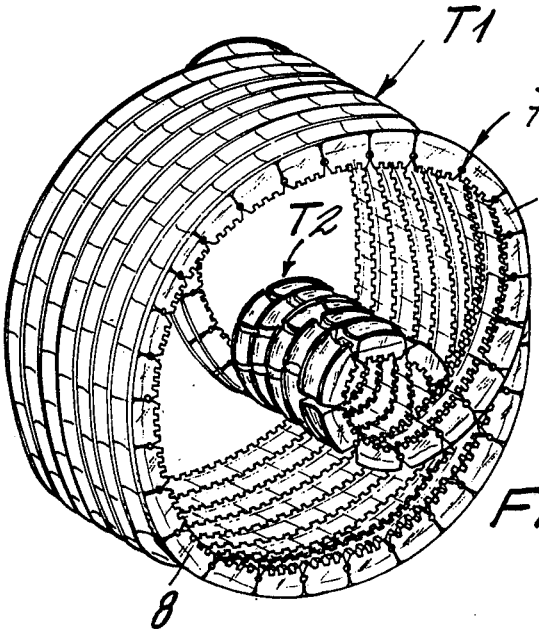
FIG. 5 is a perspective view showing the track at the configuration taken in the device.
Figure 3:
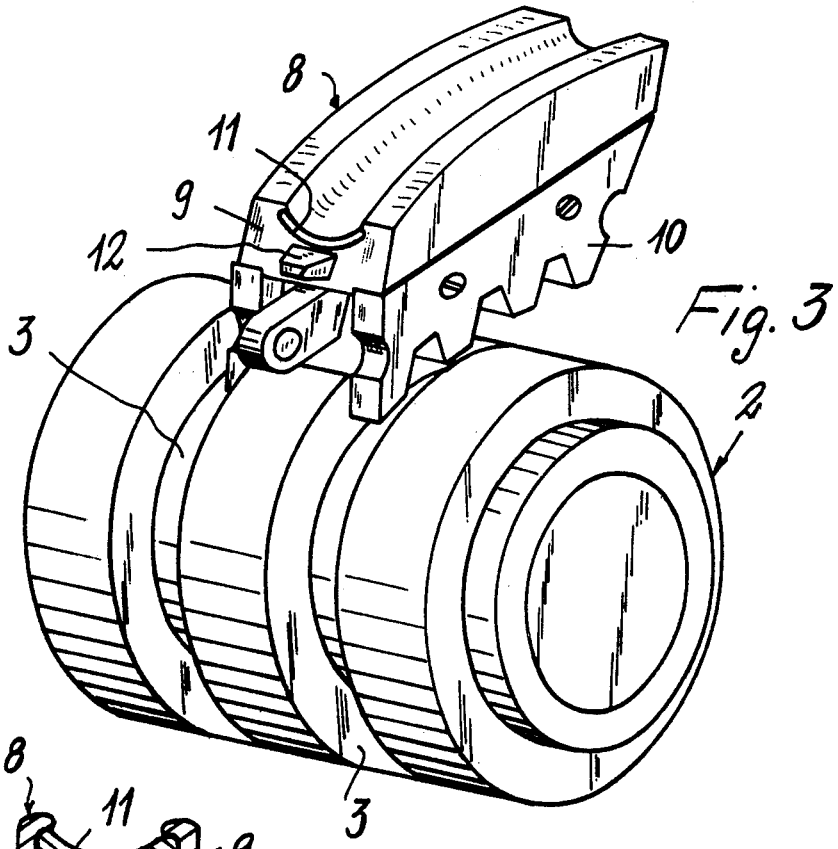
FIG. 3 is an enlarged perspective view showing a detail relating to the connection between a track portion and a given type of roller.

The above described track 7 is shown in FIG. 5 according to the configuration that it takes when mounted on the several rollers; as above mentioned, said FIG. 5 shows the track only, that is the several rollers have been omitted for a better illustration of the track. In said FIG. 5, reference T1 indicates said section or length forming the outer helix, and reference T2 indicates said section or length forming the inner helix. The rope is carried by track 7, or is accomodated within the track groove comprising said flange 11; in other terms, the rope is carried by the outer cylinder comprising said track section or length T1, or is helically wound up and accomodated in said track groove.

The teeth of the track parts 10 mesh with the toothing of the driving rollers 1. The toothing of said rollers 1 is provided at a slope, so that the tooth generatrix is normal to the track winding direction, such an expedient being provided for allowing a smooth meshing between the contacting elements. The track comprises elements having the end faces machined according to planes concurrent with a single axis, the latter being the axis for the theoretical wheel equivalent to the system comprising the roller assembly.

Thus, when helically wrapped or wound, said track forms a cylinder supported by the outer rollers 1 and 2, which cylinder is capable of reacting against the compressive forces caused by the rope. The above mentioned teeth 12, as inserted in the proper seatings thereof, enable the track to react against the centerwise directed forces.

The above described groove-shaped flange 11, for example semicircular in cross-section, provides good contact conditions between the rope and track. In case of wear, said flange 11 can be readily replaced. When the toothed cylinders are rotated, the track engaging thereon is moved by a helical motion. In the movement thereof, all of the elements cover the external surface of the supporting rollers 1 and 2, then entering therebetween, arriving at idle roller 6, covering also the latter and re-appearing on the external surface to start the cycle again. The rope being wound up on the outside band of the track, by adhering thereto will describe a spiral which, unlike all of the other adhering systems, has no motion relative to its mounting. The most obvious advantages obtainable by using an adhering wheel according to the invention are as follows:

(1) The rope undergoes only one bending cycle and no forces arise tending to torsionally stress the same.

(2) Since during its passage on the wheel said rope maintains a constant degree of its curvature, no overstress occurs during the passage of the connection joint between the several lengths or sections. According to the present invention, any type of joint can be caused to pass on the adhering wheel, even of substantial dimensions, such as the compressive joint normally used for connection between two lengths of conductors in aerial electrical lines.

(3) The strains resulting from the rope winding are supported only by the track in the form of internal strains. Thus, the various elements transmit to one another such loads as those received by the rope compression due to mutual reaction. The carrying rollers receive only the stress resulting from the difference between the inlet rope pull and the outlet rope pull, which is a reasonable stress when referred to the compressive loads resulting from the rope winding. The features of the above described type of adhering wheel according to the invention make such a wheel particularly suitable for installation of the conductors in aerial electrical lines. These conductors comprise elemental steel wires and elemental aluminum wires, all of which generally having the same diameter, and spirally combined to one another in several layers. The steel wires make up the inner portion of the conductors and perform the function of improving the tensile strength thereof, whereas the outer aluminum wires generally accomplish the purpose of electrical power transmission.

In large long-distance lines, where power transportation is effected at a high potential, it is highly important that the conductors are installed as integral as possible, since impairment thereof, when considered from electrical standpoint, would reduce the efficiency thereof due to losses by corona effect, while from a mechanical standpoint would reduce the tensile strength thereof, impairing the safety coefficient which in these installations is already unavoidably low.

Over presently used devices, an adhering wheel according to the invention is the unique enabling to brake the conductor during assembling of long-distance lines, operation which is required in order to prevent the conductor from sliding on the ground between one mounting and the other, without any change to the structure thereof.

As a variant to the foregoing described matter, the track or chain translation on the supporting or driving rollers can be provided by V-grooves, so that, as a result of the friction developing between such grooves and track, forward movement of the latter is provided.

What is claimed is:

1. An adhering device for winding ropes thereon, comprising:

a looped track;

means for supporting a first portion of said track to define a first cylindrical surface formed by a plurality of helical turns of said track;

means for supporting a second portion of said track to define a second cylindrical surface formed by a plurality of helical turns of said track, said second cylindrical surface being disposed internally of said first cylindrical surface and coaxial therewith;

and means for driving said track so that each point on the track, moves along a path including a helical length about said first cylindrical surface and a helical length about said second cylindrical surface internally of said first surface, so that each point on the track, after traversing said helical length on said first cylindrical surface will traverse the helical length on said second cylindrical surface and then re-traverse said first surface and so on, said track being provided with a groove for accomodating the rope winding up on said track along the helical length of said first cylindrical surface.

2. A device according to claim 1, wherein said first supporting means comprises:

a frame;

a set of rollers carried by mountings integral with the frame, the geometrical axes of the rollers arranged on a cylindrical surface, and said rollers being rotatable about their axes, said set of rollers supporting said first portion of said track in said helical length on said first cylindrical surface;

and said second supporting means comprises at least one inner roller rotatable about its axis on a mounting integral with said frame and disposed along the axis of said first and second cylindrical surfaces, and on which said second portion of said track is wound, thus forming said helical length about said second cylindrical surface;

said means for driving being coupled to some of said rollers defining said first supporting means so as to rotate said rollers about the axes thereof, said inner roller being an idle roller.

3. A device according to claim 2, wherein some of said rollers are provided with sloping teeth for cooperating with complementary teeth provided on the inner surface of said track, and wherein further rollers cooperating to define the first supporting means are provided with at least one circumferential guide member.

4. A device according to claim 3, wherein said track comprises a series of track elements, each of which in turn comprises a toothed portion intended to cooperate with the toothed driving rollers, and a second portion integral with said toothed portion, the second portion having a groove for accomodating said rope, said elements including means for hinging one to another.

5. A device according to claim 4, wherein said second portion of the track element includes means for releasably receiving a removable flange made of plastic material and shaped so as to form a groove for the rope.

6. A device according to claim 4, wherein each of the track elements has a projection at one end, and at the other end a recess for accomodating the projection of the adjacent element.

7. A device according to claim 4, wherein said means for hinging includes a cylindrical hinge pin inserted in aligned holes in adjacent elements, so as to supply said track with an excellent flexibility in the longitudinal plane and a reasonable flexibility in the transverse plane as determined by the clearance provided between the pin and holes.

* * * * *